US009862161B2

(12) United States Patent
Fath

(10) Patent No.: US 9,862,161 B2
(45) Date of Patent: Jan. 9, 2018

(54) BLANKS FOR DISPLAY PACKAGE CONTAINING CARTOMIZER BLISTER PACK AND METHODS OF FORMING DISPLAY PACKAGE FOR CARTOMIZER BLISTER PACK

(71) Applicant: Scott A. Fath, Richmond, VA (US)

(72) Inventor: Scott A. Fath, Richmond, VA (US)

(73) Assignee: ALTRIA CLIENT SERVICES, LLC, Richmond, VA (US)

( * ) Notice: Subject to any disclaimer, the term of this patent is extended or adjusted under 35 U.S.C. 154(b) by 0 days.

(21) Appl. No.: 14/725,601

(22) Filed: May 29, 2015

(65) Prior Publication Data

US 2015/0344169 A1 Dec. 3, 2015

Related U.S. Application Data

(60) Provisional application No. 62/004,311, filed on May 29, 2014.

(51) Int. Cl.
*B65D 5/20* (2006.01)
*B65D 5/42* (2006.01)
(Continued)

(52) U.S. Cl.
CPC ..... *B31B 13/00* (2013.01); *B65D 5/18* (2013.01); *B65D 5/548* (2013.01); *B65D 5/4216* (2013.01); *B65D 5/6685* (2013.01)

(58) Field of Classification Search
CPC ..... B65D 5/2076; B65D 5/18; B65D 5/4266; B65D 5/548; B31B 13/00
(Continued)

(56) References Cited

U.S. PATENT DOCUMENTS 83,812 A * 11/1868 Wilcox ..... B65D 5/06 229/125.38
362,583 A * 5/1887 Jordan ..... B65D 5/06 229/138
(Continued)

FOREIGN PATENT DOCUMENTS

DE 10 2011 107531 A1 1/2013
FR 764282 A * 5/1934 ..... B65D 5/18
(Continued)

OTHER PUBLICATIONS

International Search Report and Written Opinion dated Oct. 20, 2015, for PCT/US2015/033260.
(Continued)

*Primary Examiner* — Christopher Demeree
(74) *Attorney, Agent, or Firm* — Harness, Dickey & Pierce, P.L.C.

(57) ABSTRACT

Blank for display packages containing a cartomizer blister pack include a top panel and a bottom panel connected to a back panel, a front panel connected to the bottom panel, a first glue panel connected to the back panel, a second glue panel connected to the back panel front, a first side panel connected to the front panel, a second side panel connected to the front panel, a first bottom side panel connected to the first glue panel, a second bottom side panel connect to the second glue panel, and a plurality of first cut lines separating the first and second bottom side panels from the bottom panel and the first and second side panels.

23 Claims, 8 Drawing Sheets

(51) Int. Cl.

| | |
|---|---|
| ***B31B 13/00*** | (2006.01) |
| ***B65D 5/18*** | (2006.01) |
| ***B65D 5/54*** | (2006.01) |
| *B65D 5/66* | (2006.01) |

(58) Field of Classification Search
USPC .... 229/200, 138, 152, 160.1, 193, 194, 126, 229/132; 206/242, 259, 800
See application file for complete search history.

(56) References Cited

U.S. PATENT DOCUMENTS

| | | | | |
|---|---|---|---|---|
| 1,390,405 | A | 9/1921 | Waldes | |
| 1,431,128 | A | 10/1922 | Sappenfield | |
| 2,114,134 | A * | 4/1938 | Weiss | B65D 5/5435 229/152 |
| 2,308,003 | A * | 1/1943 | Gamrod | A45C 11/38 224/908 |
| 2,789,746 | A * | 4/1957 | Hovland | B65D 5/548 229/145 |
| 2003/0047470 | A1 | 3/2003 | Parker | |
| 2011/0024487 | A1 | 2/2011 | Caceres et al. | |

FOREIGN PATENT DOCUMENTS

| | | | |
|---|---|---|---|
| WO | WO-99/28212 | A1 | 6/1999 |
| WO | WO-2009/106535 | A1 | 9/2009 |

OTHER PUBLICATIONS

Notification Concerning Transmittal of International Preliminary Report on Patentability and International Preliminary Report on Patentability from related International Application PCT/US2015/033260, dated Dec. 8, 2016.

* cited by examiner

BLANKS FOR DISPLAY PACKAGE CONTAINING CARTOMIZER BLISTER PACK AND METHODS OF FORMING DISPLAY PACKAGE FOR CARTOMIZER BLISTER PACK

CROSS-REFERENCE TO RELATED APPLICATION(S)

This application is a non-provisional application that claims the benefit of priority under 35 U.S.C. §119(e) to U.S. Provisional Application No. 62/004,311, filed on May 29, 2014, the content of which is incorporated herein by reference in its entirety.

BACKGROUND

Field

Example embodiments relate to blanks for a display package containing a cartomizer blister pack and/or methods of forming a display package for a cartomizer blister pack using the same.

Related Art

Electronic vaping devices are generally packaged to include a cartomizer. Features (e.g., smell and taste) of the cartomizer can be sensitive to external factors. The external factors may be introduced by accidental opening of the display package or a blister pack containing the cartomizer, tampering of the display package or a blister pack containing the cartomizer by a consumer, etc. These are some factors that are taken into consideration when forming display packages containing a cartomizer blister pack.

Another factor that is taken into consideration is the ability to manufacture a blank for the display package using high-speed equipment.

SUMMARY

Some example embodiments relate to blanks for a display package containing a cartomizer blister pack and/or methods of forming a display package for a cartomizer blister pack using the same.

Some example embodiments relate to blanks for a display package having a tamper-evident feature and/or methods of forming a display package using the same.

Some example embodiments relate to blanks for a display package for packaging on high-speed equipment (e.g., equipment configured to manufacture/form about 300 or more display packages per minute) and/or methods of forming a display package for a cartomizer blister pack using the same.

To achieve application for high speed manufacturing, some example embodiments relate to blanks provided in a flat, die-cut manner that allows for the flat, die-cut blanks to be folded and glued in an effective manner (or, alternatively, erected into display packages) while an item is placed inside of the display packages simultaneous with the folding and/or gluing of the blanks.

In accordance with some example embodiments, a blank for a display package, includes a top panel connected to a back panel along a first fold line, the first fold line extending along a top edge of the back panel, a bottom panel connected to the back panel along a second fold line, the second fold line extending along a top edge of the bottom panel, a front panel connected to the bottom panel along a third fold line, the third fold line extending along a top edge of the front panel, a first glue panel connected to the back panel along a fourth fold line, the fourth fold line extending along a first side edge of the back panel, a second glue panel connected to the back panel front along a fifth fold line, the fifth fold line extending along a second side edge of the back panel, a first side panel connected to the front panel along a sixth fold line, the sixth fold line extending along a first side edge of the front panel, a second side panel connected to the front panel along a seventh fold line, the seventh fold line extending along a second side edge of the front panel, a first bottom side panel connected to the first glue panel along an eighth fold line, the eighth fold line extending along a lower edge of the first glue panel, and a second bottom side panel connect to the second glue panel along an ninth fold line, the ninth fold line extending along a lower edge of the second glue panel. A plurality of first cut lines extend along lower edges of the first and second bottom side panels so as to separate the first and second bottom side panels from the bottom panel and the first and second side panels.

The blank may further include a lower panel connected to the front panel along a bottom edge of the front panel.

The blank may further include at least one second cut line in a semi-circular shape at an upper portion of back panel.

The blank may be formed of a material selected from cardboard, paperboard, plastic, metal, and combinations thereof.

In accordance with some example embodiments, a blank for a display package, includes a top panel connected to a front panel along a first fold line, the first fold line extending along a top edge of the front panel, a bottom panel connected to the front panel along a second fold line, the second fold line extending along a top edge of the bottom panel, a back panel connected to the bottom panel along a third fold line, the third fold line extending along a top edge of the back panel, a first side panel connected to the front panel along a fourth fold line, the fourth fold line extending along a first side edge of the front panel, a second side panel connected to the front panel along a fifth fold line, the fifth fold line extending along a second side edge of the front panel, a first glue panel connected to the back panel along a sixth fold line, the sixth fold line extending along a first side edge of the back panel, a second glue panel connected to the back panel along a seventh fold line, the seventh fold line extending along a second side edge of the back panel, a first bottom side panel connected to the first glue panel along an eighth fold line, the eighth fold line extending along a top edge of the first glue panel, and a second bottom side panel connect to the second glue panel along an ninth fold line, the ninth fold line extending along a top edge of the second glue panel. A plurality of first cut lines extend along upper edges of the first and second bottom side panels so as to separate the first and second bottom side panels from the bottom panel and the first and second side panels.

The blank may further include a flap panel connected along a first flap fold line at a top edge of the top panel.

The back panel may include a third glue panel configured to be bonded to an inner surface of the flap panel upon assembly of the display package.

A lower portion of the back panel may include a semi-circular cut-out, and the semi-circular cut-out may be at an upper portion of the back panel upon assembly of the display package.

The blank may further include a first flap panel connected to the first side panel along a tenth fold line, the tenth fold line extending along a top edge of the first side panel, and a second flap panel connected to the second side panel along an eleventh fold line, the eleventh fold line extending along a top edge of the second side panel.

In accordance with some example embodiments, a method of forming a display package, includes erecting the display package from a blank. The blank includes a top panel connected to a back panel along a first fold line, the first fold line extending along a top edge of the back panel, a bottom panel connected to the back panel along a second fold line, the second fold line extending along a top edge of the bottom panel, a front panel connected to the bottom panel along a third fold line, the third fold line extending along a top edge of the front panel, a first glue panel connected to the back panel along a fourth fold line, the fourth fold line extending along a first side edge of the back panel, a second glue panel connected to the back panel front along a fifth fold line, the fifth fold line extending along a second side edge of the back panel, a first side panel connected to the front panel along a sixth fold line, the sixth fold line extending along a first side edge of the front panel, a second side panel connected to the front panel along a seventh fold line, the seventh fold line extending along a second side edge of the front panel, a first bottom side panel connected to the first glue panel along an eighth fold line, the eighth fold line extending along a lower edge of the first glue panel, and a second bottom side panel connect to the second glue panel along a ninth fold line, the ninth fold line extending along a lower edge of the second glue panel. A plurality of first cut lines extend along lower edges of the first and second bottom side panels so as to separate the first and second bottom side panels from the bottom panel and the first and second side panels. The erecting the display package includes folding the first glue panel and the second glue panel along the fourth and fifth fold lines, folding the first and second bottom side panels along the eighth and ninth fold lines, folding the front panel along the third fold line, and bonding the first and second side panels to the first and second glue panels.

The method may further include connecting a lower panel to the front panel along a bottom edge of the front panel.

The method may further include forming at least one second cut line in a semi-circular shape at an upper portion of back panel.

The method may further include placing at least one blister pack on the blank before the bonding the first and second side panels.

The at least one blister pack may comprise two-or-four cavities, and each of the cavities may be configured to hold at least one cartomizer.

The method may further include forming the blank into a flat die-cut manner, prior to the erecting the display package.

The method may further include placing at least one blister pack on the blank simultaneously with the folding of the front panel.

The method may further include placing at least one blister pack on the blank simultaneously with the folding the first and second bottom side panels.

In accordance with some example embodiments, a method of forming a display package, includes erecting the display package from a blank. The blank includes a top panel connected to a front panel along a first fold line, the first fold line extending along a top edge of the front panel, a bottom panel connected to the front panel along a second fold line, the second fold line extending along a top edge of the bottom panel, a back panel connected to the bottom panel along a third fold line, the third fold line extending along a top edge of the back panel, a first side panel connected to the front panel along a fourth fold line, the fourth fold line extending along a first side edge of the front panel, a second side panel connected to the front panel along a fifth fold line, the fifth fold line extending along a second side edge of the front panel, a first glue panel connected to the back panel along a sixth fold line, the sixth fold line extending along a first side edge of the back panel, a second glue panel connected to the back panel along a seventh fold line, the seventh fold line extending along a second side edge of the back panel, a first bottom side panel connected to the first glue panel along an eighth fold line, the eighth fold line extending along a top edge of the first glue panel, and a second bottom side panel connect to the second glue panel along an ninth fold line, the ninth fold line extending along a top edge of the second glue panel. A plurality of first cut lines extend along upper edges of the first and second bottom side panels so as to separate the first and second bottom side panels from the bottom panel and the first and second side panels. The erecting the display package includes folding the first side panel and the second glue panel along the fourth and fifth fold lines, folding the first and second bottom side panels along the eighth and ninth fold lines, folding the back panel along the third fold line, and bonding the first and second side panels to the first and second glue panels.

A lower portion of the back panel may include a semi-circular cut-out, and the semi-circular cut-out may be at an upper portion of the back panel upon assembly of the display package.

The blank may further include a flap panel connected along a first flap fold line at a top edge of the top panel, a first flap panel connected to the first side panel along a tenth fold line, the tenth fold line extending along a top edge of the first side panel, and a second flap panel connected to the second side panel along a eleventh fold line, the eleventh fold line extending along a top edge of the second side panel. The erecting the display package may further include folding the first and second flap panels along the tenth and eleventh fold lines, and tucking the flap panel into an inner portion of the display package.

The back panel may include a third glue panel configured to be bonded to an inner surface of the flap panel upon assembly of the display package.

BRIEF DESCRIPTION OF THE DRAWINGS

Example embodiments will be more clearly understood from the following detailed description taken in conjunction with the accompanying drawings.

FIG. 1 is a plan view of a printable or clay side of a blank for forming a cartomizer box in accordance with some example embodiments, FIG. 2 is a plan view of an inside of the blank for forming a cartomizer box as shown in FIG. 1 showing the fold and cut lines, FIG. 3 is an end view of an erected box formed using the blank shown in FIGS. 1 and 2, FIG. 4 is plan view of a printable or clay side of a blank for forming a cartomizer box in accordance with some example embodiments, FIG. 5 is plan view of an inside of the blank for forming a cartomizer box as shown in FIG. 4 showing the fold and cut lines, FIG. 6 is a plan view of a printable or clay side of a blank for forming a cartomizer box in accordance with some example embodiments, FIG. 7 is a plan view of an inside of the blank for forming a cartomizer box as shown in FIG. 6 showing the fold and cut lines, FIG. 8 is a plan view of a printable or clay side of a blank for forming a cartomizer box in accordance with some example embodiments, and FIG. 9 is a plan view of an inside of the blank for forming a cartomizer box as shown in FIG. 8 showing the fold and cut lines.

DETAILED DESCRIPTION

Figure 1:
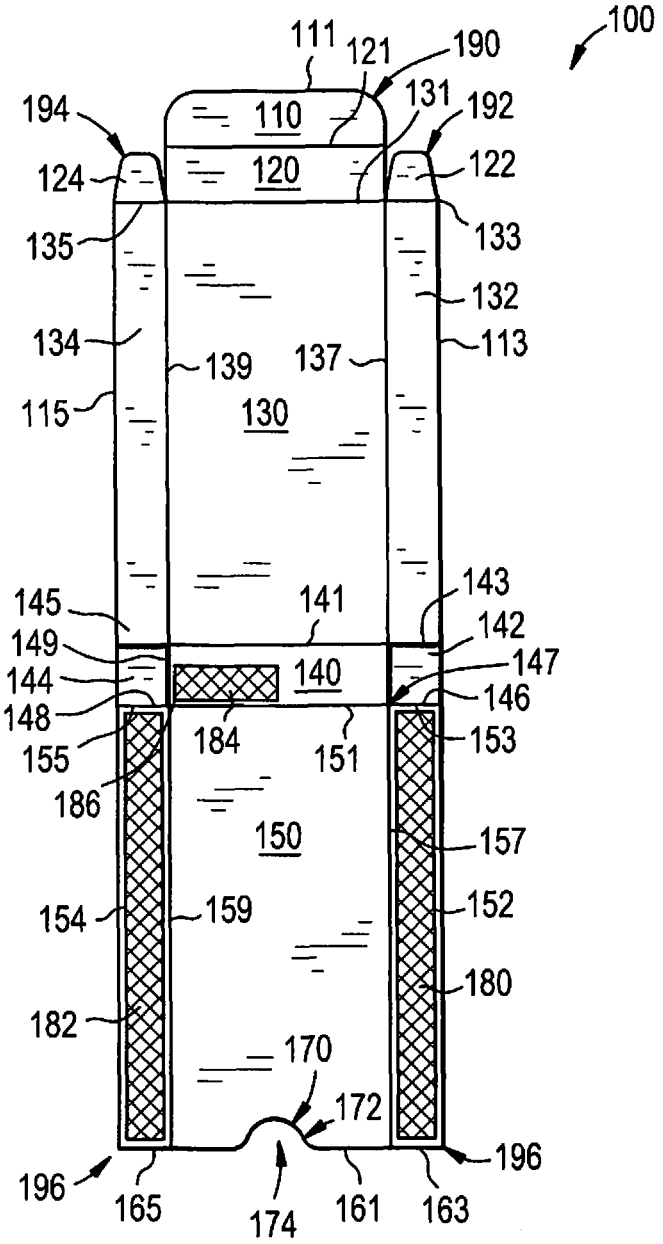
FIGS. 1-9 represent some non-limiting, example embodiments as described herein.

Various example embodiments will now be described more fully with reference to the accompanying drawings in which some example embodiments are shown. However, specific structural and functional details disclosed herein are merely representative for purposes of describing example embodiments. Thus, the invention may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

In the drawings, the thicknesses of layers and regions may be exaggerated or under-exaggerated for clarity or scaling, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments, various features will be described in detail with reference to the attached drawings. However, example embodiments described are not limited thereto.

Example embodiments relate to blanks for a display package containing a cartomizer blister pack and/or methods of forming a display package for a cartomizer blister pack using the same.

FIG. 1 is a plan view of a printable or clay side of a blank for forming a cartomizer box in accordance with some example embodiments.

In FIG. 1, a blank 100 for forming a cartomizer box operable to contain at least one blister tray 420 and an optional instruction booklet 410 (FIG. 3) is shown. In accordance with some example embodiments, the blanks 100, 500, 600 (shown in FIGS. 1, 2, and 4-9) can be used with high-speed equipment, for example, equipment, which can handle 300 or more display packs per minute.

Referring to FIG. 1, the blank 100 includes a flap panel 110, a top panel 120, a front panel 130, a bottom panel 140, and a back panel 150. In accordance with some example embodiments, the flap panel 110 is connected to the top panel 120 at a top edge 121 of the top panel 120. The flap panel 110 has a free edge 111 with a pair of rounded edges 190. The top panel 120 is connected to the front panel 130 at a top edge 131 of the front panel 130. The bottom panel 140 is connected to the front panel 140 at a top edge of the bottom panel 141. The back panel 150 is connected to the bottom panel 140 at a top edge 151 of the back panel 150.

In accordance with some example embodiments, a first side panel 132 and a second side panel 134 are connected to the front panel 130 along a first side edge 137 and a second side edge 139 of the front panel 130. A first flap panel 122 and a second flap panel 124 are connected to a top edge 133, 135 of the first and second side panels 132, 134, respectively. Each of the first and second flap panels 122, 124 have a pair of rounded edges 192, 194.

In accordance with some example embodiments, the bottom panel 140 has a first bottom side panel 142 and a second bottom side panel 144, which extend from a first side edge 147 and second side edge 149 of the bottom panel 140.

In accordance with some example embodiments, the bottom panel 140 may also include a varnish-free area 184, which may be configured to receive a date code 186. The varnish-free area 184 on the bottom panel 140 may have a rectangular shape and may be located in a lower left corner of the bottom panel 140. For example, in accordance with some example embodiments, the varnish-free area 184 may have a width of about 25 mm to about 35 mm, and more preferably about 28 mm, and a height of about 6 mm to about 10 mm, and more preferably about 8 mm.

In accordance with some other example embodiments, the bottom panel 140 may not include the varnish-free area 184 and/or the date code 186. In accordance with some example embodiments, the varnish-free area 184 and/or the date code 186 may be located on another area of the bottom panel 140.

A first glue panel 152 and the second glue panel 154 extend from a first side edge 157 and a second side edge 159 of the back panel 150, respectively. The first and second glue panels 152, 154 have the top edge 153, 155 and a bottom edge 163, 165, respectively. The first and second glue panels 152, 154 can be connected to the first side bottom panel 142 and the second side bottom panel 144 along the top edge 153, 155, respectively, of the first and second glue panels 152, 154. The first and second side bottom panels 142, 144 each have a lower edge 146, 148, and a top edge 143, 145. In accordance with some example embodiments, the top edge 143, 145 are free edges (or cut lines), which have been separated from the lower edge of the first and second side panels 132, 134, respectively. In accordance with some example embodiments, the each of the first and second glue panels 152, 154 may have a varnish-free area 180, 182, which can cover essentially the entire face of the glue panels 152, 154. In accordance with some example embodiments, the back panel 150 can have an optional cutout 174 on a lower edge 161 of the back panel 150. The cutout 174 can be in the shape of a semi-circular shape. For example, in accordance with some example embodiments, for example, the cutout 174 can have a radius 170 of about 9 mm to 10 mm, and more preferably about 9.29 mm. In accordance with some example embodiments, a center point of the cutout is about 27.5 mm from the first and the second side edges 157, 159 of the back panel 150. In accordance with some example embodiments, the lower edges 172 of the cutout 174 can be rounded. For example, the lower edges 172 can have a radius of about 3 mm.

In accordance with some example embodiments, each of the first and second glue panels 152, 154 has a free edge 163, 165 on a lower edge of the blank 100. The blank 100 has a pair of free edges 113, 115, which extend from an outer portion of the top edge 133, 135 of the first and second side panels 132, 134 to the free edges 163, 165 of the lower edge of the first and second glue panels 152, 154. In accordance with some example embodiments, the corners 196, which transition from the free edges 113, 115 of the blank 100 to the lower free edges 163, 165 of the first and second glue panels 152, 154 can be rounded. For example, in accordance with some example embodiments, the corners 196 can have a radius of about 1 mm.

As shown in FIG. 1, the front panel 130 and the back panel 150 can have substantially the same height and width. For example, in accordance with some example embodiments, the front panel 130 and the back panel 150 can have a width of about 50 mm to 60 mm, and more preferably 55 mm, and a height of about 105 mm to about 115 mm, and more preferably about 109 mm.

In accordance with some example embodiments, the first side panel 132, the second side panel 134, the first glue panel 152, and the second glue panel 154 can have substantially the same height and width. For example, in accordance with some example embodiments, the first side panel 132, the second side panel 134, the first glue panel 152, and the second glue panel 154 can have a width of about 12 mm to 16 mm, and more preferably about 13 mm, and a height of about 105 mm to about 115 mm, and more preferably about 109 mm.

In accordance in with some example embodiments, the top panel 120 and the bottom panel 140 can have substantially the same height and width. For example, in accordance with some example embodiments, the top panel 120 and the bottom panel 140 can have a width of about 50 mm to 60 mm, and more preferably a width of about 54.2 mm, and a height of about 10 mm to 15 mm, and more preferably the top panel 120 has a height of about 13.5 mm, and the bottom panel 140 has a height of about 14 mm.

In accordance with some example embodiments, the blank 100 can have an overall height of about 250 mm to about 270 mm, and more preferably about 260.5 mm, and a width of about 75 mm to about 85 mm, and more preferably about 81 mm. In accordance with some example embodiments, the pair of rounded edges 192, 194 can have a radius of about 7 mm.

Figure 2:
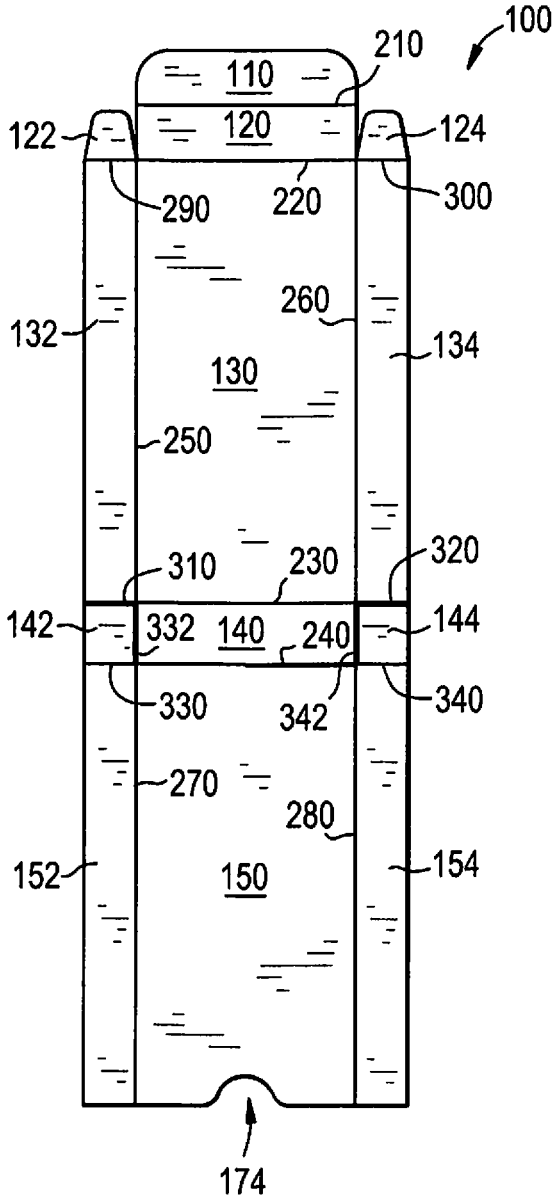

FIG. 2 is a plan view of an inside of the blank for forming a cartomizer box as shown in FIG. 1 showing the fold and cut lines.

Referring to FIG. 2, the flap panel 110 is connected to the top panel 120 along a first flap fold line 210. The top panel 120 is connected to the front panel 130 along a first fold line 220. The front panel 130 is connected to the bottom panel 140 along a second fold line 230. The bottom panel 140 is connected to the back panel 150 along a third fold line 240. The first and second side panels 132, 134 are connected to the front panel 130 along a fourth and fifth fold line 250, 260, respectively. The first and second glue panels 152, 154 are connected to the back panel 150 along a sixth and seventh fold line 270, 280, respectively. The first and second flap panels 122, 124 are connected to the first and second side panels 132, 134 along an eighth and ninth fold line 290, 300, respectively.

In accordance with some example embodiments, the first bottom side panel 142 and the second bottom side panel 144 are connected to the first and second glue panels 152, 154 along a tenth and an eleventh fold line 330, 340, respectively. The blank 100 also includes a series of cuts 310, 332, 320, 342, which separates the first and second bottom side panels 142, 144 from the bottom panel 140 to assist with the assembly or gluing of the box structure during assembly.

Figure 3:
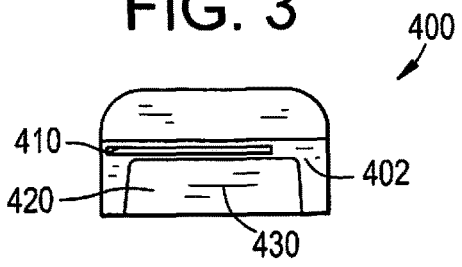

FIG. 3 is an end view of the erected pack or box formed from the blank as shown in FIGS. 1 and 2.

Referring FIG. 3, an erected package or box 400 includes a rectangular box portion, which is a substantially rectangular parallelepipedal shaped box, with right-angled longitudinal and right-angled transverse edges. In accordance with some example embodiments, an inner cavity 402 of the erected box 400 can be configured to contain at least one blister tray 420 and an optional instruction booklet 410, as shown. The at least one blister tray 420 is configured to hold at least one, two or four cartomizers for an electronic vaping device. In accordance with some example embodiments, the package or box 400 may be configured to hold a 4 cavity blister, however, if a 2 cavity blister pack is used in place of the 4 cavity blister pack, an inner frame (not shown) can be used to elevate the blister packs in the package or box 400. In addition, the blank 100 can be configured such that upon assembly of the blank 100 into a pack or box 400, the pack or box 100 must be torn apart to access the cartomizers 420 so as to indicate that the pack 400 has been opened.

Figure 4:
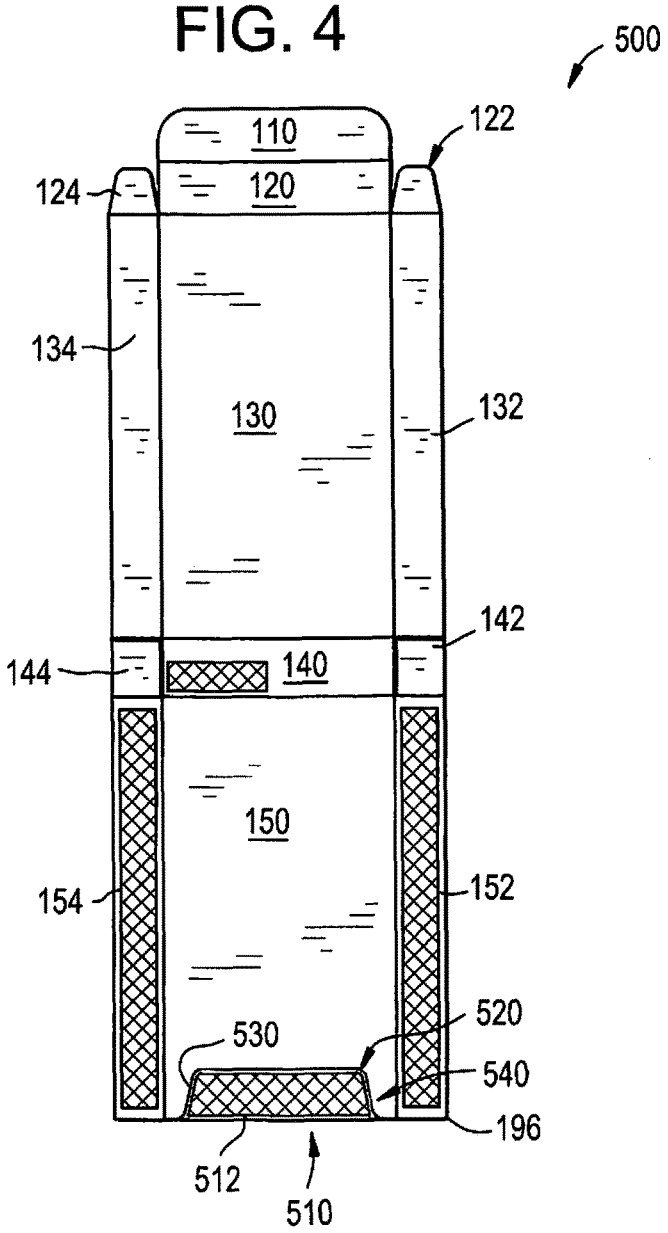

FIG. 4 is a plan view of a printable or clay side of a blank for forming a cartomizer box in accordance with some example embodiments.

Referring to FIG. 4, a blank 500 includes a flap panel 110, a top panel 120, a front panel 130, a bottom panel 140, and a back panel 150 with corresponding flap panels 122, 124, side panels 132, 134, bottom side panels 142, 144, and glue panels 152, 154. The blank 500 as shown in FIG. 4 includes a lower glue panel 510 in place of the optional lower cutout 174 as shown in FIGS. 1 and 2 on the back panel 150. In accordance with some example embodiments, the lower glue panel 510 includes a varnish-free area 512. The lower glue panel 510 has a cut line, which upon assembly of the box 400, the lower glue panel 510 can be attached to an inner portion of the flap panel 110.

In accordance with some example embodiments, the lower glue panel 510 can have a generally rectangular shape and a pair of angled (or, alternatively, sloped) outer edges 530 with rounded corners 520 on upper portion thereof. In accordance with some example embodiments, for example, the rounded corners 520 can have a radius of about 2 mm to about 4 mm, for example, about 3 mm. In accordance with some example embodiments, the pair of angled outer edges 530 can have an angle of between about 5 degrees to 15 degrees angled (or, alternatively, sloped) inward from the outer edges of the blank 500, or, the angle may be about 10 degrees. In accordance with some example embodiments, a lower portion of the lower glue panel 510 can have a pair of slightly rounded corners 540 on a lower portion of the back panel 150. For example, in accordance with the lower glue panel 510 can have a width of about 40 mm to about 50 mm, and more preferably about 44 mm, and a height of about 10 mm to about 15 mm, and more preferably about 13 mm.

Figure 5:
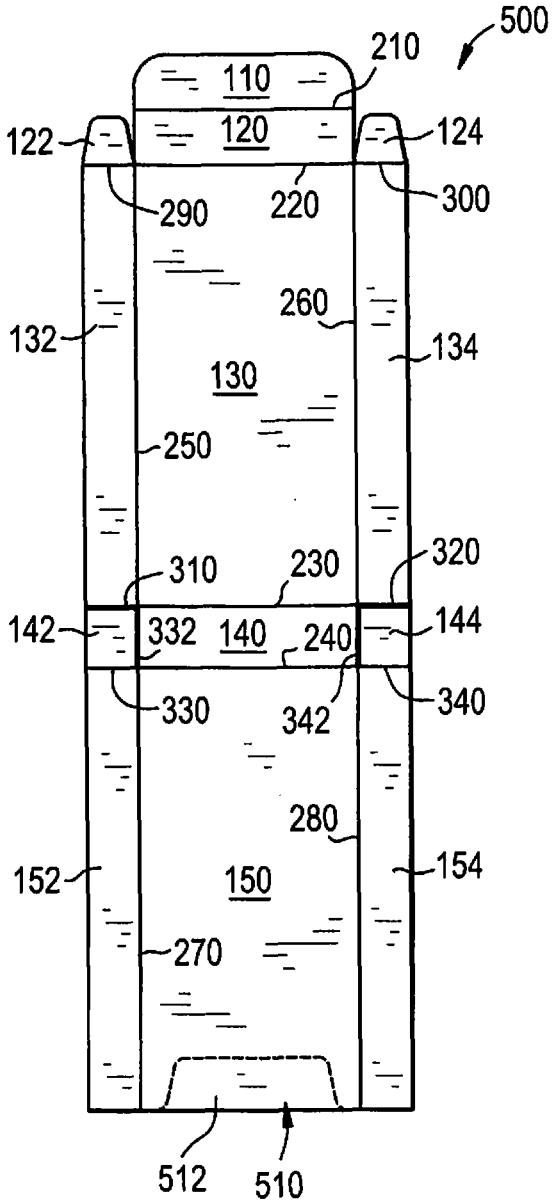

FIG. 5 is a plan view of an inside of the blank for forming a cartomizer box as shown in FIG. 4 showing the fold and cut lines.

Referring to FIG. 5, the flap panel 110 is connected to the top panel 120 along a first flap fold line 210. The top panel 120 is connected to the front panel 130 along a first fold line 220. The front panel 130 is connected to the bottom panel 140 along a second fold line 230. The bottom panel 140 is connected to the back panel 150 along a third fold line 240. The first and second side panels 132, 134 are connected to the front panel 130 along a fourth and fifth fold line 250, 260, respectively. The first and second glue panels 152, 154 are connected to the back panel 150 along a sixth and seventh fold line 270, 280, respectively. The first and second flap panels 122, 124 are connected to the first and second side panels 132, 134 along an eighth and ninth fold line 290, 300, respectively.

In accordance with some example embodiments, the first bottom side panel 142 and the second bottom side panel 144 are connected to the first and second glue panels 152, 154 along a tenth and an eleventh fold line 330, 340, respectively. The blank 500 also includes a series of cuts 310, 332, 320, 342, which separates the first and second bottom side panels 142, 144 from the bottom panel 140 to assist with the assembly or gluing of the box structure during assembly.

Figure 6:
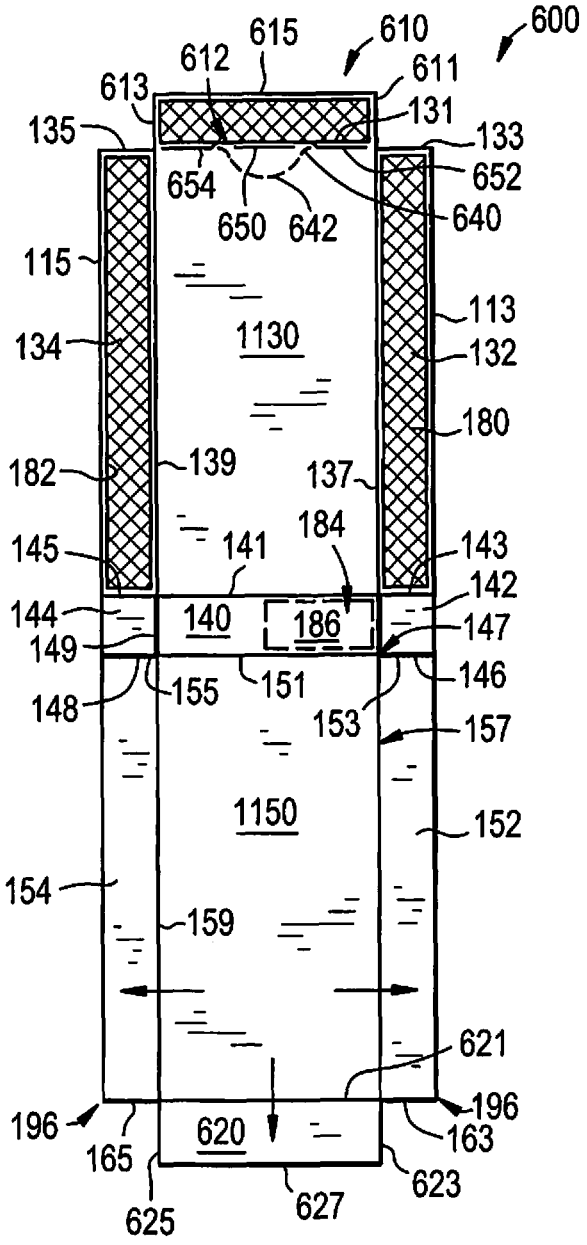

FIG. 6 is a plan view of a printable or clay side of a blank for forming a cartomizer box in accordance with some example embodiments.

Referring to FIG. 6, a blank 600 includes a top (or upper) glue panel 610, a back panel 1130, a bottom panel 140, a front panel 1150, and a lower panel 620. In accordance with some example embodiments, the top glue panel 610 is connected to the back panel 1130 at a top edge 131 of the back panel 1130. The top glue panel 610 has a varnish-free area 612, which can cover essentially the entire face of the glue panel 610. The back panel 1130 can include one or more cut lines 640, which collectively form a semi-circular tab 642. The one or more cut lines 640, which collectively form the semi-circular tab 642, can assist with opening of the box 400.

The one or more cut line 640 may collective define a tear line, which can assist and/or provide access for a consumer to the contents enclosed within the box. The tear line can also function as a tamper-evident feature. For instance, upon breaking the tear line provided by the cut lines 640, connectors are formed in a corresponding area as raised portions 656, 658 (shown in FIG. 7), and a tab defined by the broken cut lines 640 is formed attached to the back panel 1130 by the connectors. The connectors are indicators that the display package has been tampered with. Upon breaking the tear line provided by the cut lines 904 and pulling the tab, the upper glue panel 970 may be separated from the back panel 918.

The bottom panel 140 is connected to the bottom panel 140 at a top edge of the bottom panel 141. The front panel 1150 is connected to the bottom panel 140 at a top edge 151 of the front panel 1150. In accordance with some example embodiments, a first glue panel 132 and a second glue panel 134 can be connected to the back panel 1130 along a first side edge 137 and a second side edge 139 of the back panel 1130, respectively. In accordance with some example embodiments, the each of the first and second glue panels 132, 134, have a varnish-free area 180, 182, which can cover essentially the entire face of the glue panels 132, 134.

In accordance with some example embodiments, the bottom panel 140 has a first bottom side panel 142 and a second bottom side panel 144, which respectively extend from a first side edge 147 and second side edge 149 of the bottom panel 140. The first and second glue panels 132, 134 can be connected to the first side bottom panel 142 and the second side bottom panel 144 along a top edge 143, 145, respectively, of the first and second side bottom panels 142, 144. The first and second side bottom panels 142, 144 each have a lower edge 146, 148. In accordance with some example embodiments, the lower edge 146, 148 are free edges, which have been separated from the upper edge 153, 155 of the first and second side panels 152, 154, respectively.

In accordance with some example embodiments, the bottom panel 140 may also include a varnish-free area 184, which may be configured to receive a date code 186. The varnish-free area 184 on the bottom panel 140 can have a rectangular shape and can be located in a lower right or left corner of the bottom panel 140. For example, in accordance with some example embodiments, the varnish-free area 184 can have a width of about 20 mm to about 30 mm, and more preferably about 26 mm, and a height of about 5 mm to about 12 mm, and more preferably about 11 mm.

In accordance with some other example embodiments, the bottom panel 140 may not include the varnish-free area 184 and/or the date code 186. In accordance with some example embodiments, the varnish-free area 184 and/or the date code 186 may be located on another area of the bottom panel 140.

A first side panel 152 and a second side panel 154 extend from a first side edge 157 and a second side edge 159 of the front panel 1150, respectively. The first and second side panels 152, 154 have a top edge 153, 155 and a bottom edge 163, 165, respectively.

In accordance with some example embodiments, each of the first and second side panels 152, 154 have a free edge 163, 165 on a lower edge of the blank 100. The blank 100 has a pair of free edges 113, 115, which extend from an outer portion of the top edge 133, 135 of the first and second glue panels 132, 134 to the free edges 163, 165 of the lower edge of the first and second side panels 152, 154. In accordance with some example embodiments, the corners 196, which transition from the free edges 113, 115 of the blank 600 to the lower free edges 163, 165 of the first and second side panels 152, 154 can be rounded. For example, in accordance with some example embodiments, the corners 196 can have a radius of about 1 mm.

In accordance with some example embodiments, as shown in FIG. 6, the top glue panel 610 has a pair of side edges 611, 613, and a top edge 615. The lower panel 620 is connected to the front panel 1150 along a bottom edge 621 of the front panel 1150. The lower panel 620 can have a pair of side edges 623, 625, and a bottom edge 627.

As shown in FIG. 6, the back panel 1130 and the front panel 1150 can have substantially the same height and width. For example, in accordance with some example embodiments, the back panel 1130 and the front panel 1150 as shown in FIG. 6 can have a width of about 50 mm to 60 mm, and more preferably 55 mm, and a height of about 105 mm to about 115 mm, and more preferably about 109 mm to about 110 mm.

In accordance with some example embodiments, the first glue panel 132, the second glue panel 134, the first side panel 152, and the second side panel 154 can have substantially the same height and width. For example, in accordance with some example embodiments, the first glue panel 132, the second glue panel 134, the first side panel 152, and the second side panel 154 can have a width of about 12 mm to 16 mm, and more preferably about 13 mm to 13.4 mm, and a height of about 105 mm to about 115 mm, and more preferably about 109 mm.

In accordance in with some example embodiments, the top glue panel 610, the bottom panel 140, and the lower panel 620 can have substantially the same height and width. For example, in accordance with some example embodiments, the top glue panel 610, the bottom panel 140, and the lower panel 620 can have a width of about 50 mm to 60 mm, and more preferably a width of about 54.2 mm, and a height of about 10 mm to 15 mm, and more preferably the top glue panel 610 and the lower panel 620 have a height of about 13.5 mm, and the bottom panel 140 has a height of about 14 mm.

In accordance with some example embodiments, the blank 100 can have an overall height of about 250 mm to about 270 mm, and more preferably about 260 mm, and a width of about 75 mm to about 85 mm, and more preferably about 81 mm.

Figure 7:
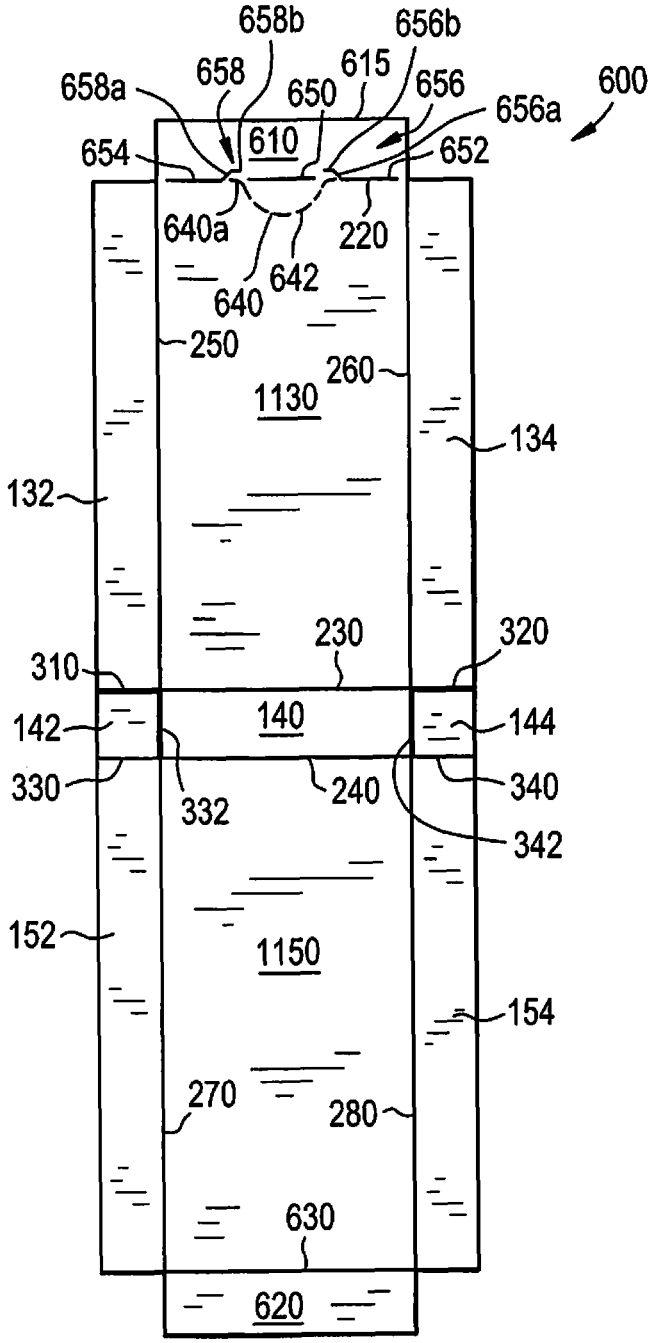

FIG. 7 is a plan view of an inside of the blank for forming a cartomizer box as shown in FIG. 6 showing the fold and cut lines.

Referring to FIG. 7, the top glue panel 610 is connected to the back panel 1130 along a first fold line 220. The first fold line 220 can include an inner fold line 650, and a pair of outer fold lines 652, 654. The pair of outer fold lines 652, 654 on an inner edge of each fold line 652, 654 can include a raised portion 656, 658, which can extends towards the top edge 615 to assist with opening of the box or pack 400. Alternatively, the first fold line 220 may be a single fold line. The back panel 1130 is connected to the bottom panel 140 along a second fold line 230. The bottom panel 140 is connected to the front panel 1150 along a third fold line 240. The front panel 1150 is connected to the top panel along a twelfth fold line 630. The first and second glue panels 132, 134 are connected to the back panel 1130 along a fourth and fifth fold line 250, 260, respectively. The first and second side panels 152, 154 are connected to the front panel 1150 along a sixth and seventh fold line 270, 280, respectively.

In accordance with some example embodiments, the first bottom side panel 142 and the second bottom side panel 144 are connected to the first and second glue panels 132, 134 along a tenth and an eleventh fold line 310, 320. The blank 600 also includes a series of cuts 330, 332, 340, 342, which separates the first and second bottom side panels 142, 144 from the bottom panel 140 to assist with the assembly or gluing of the box structure during assembly.

Figure 8:
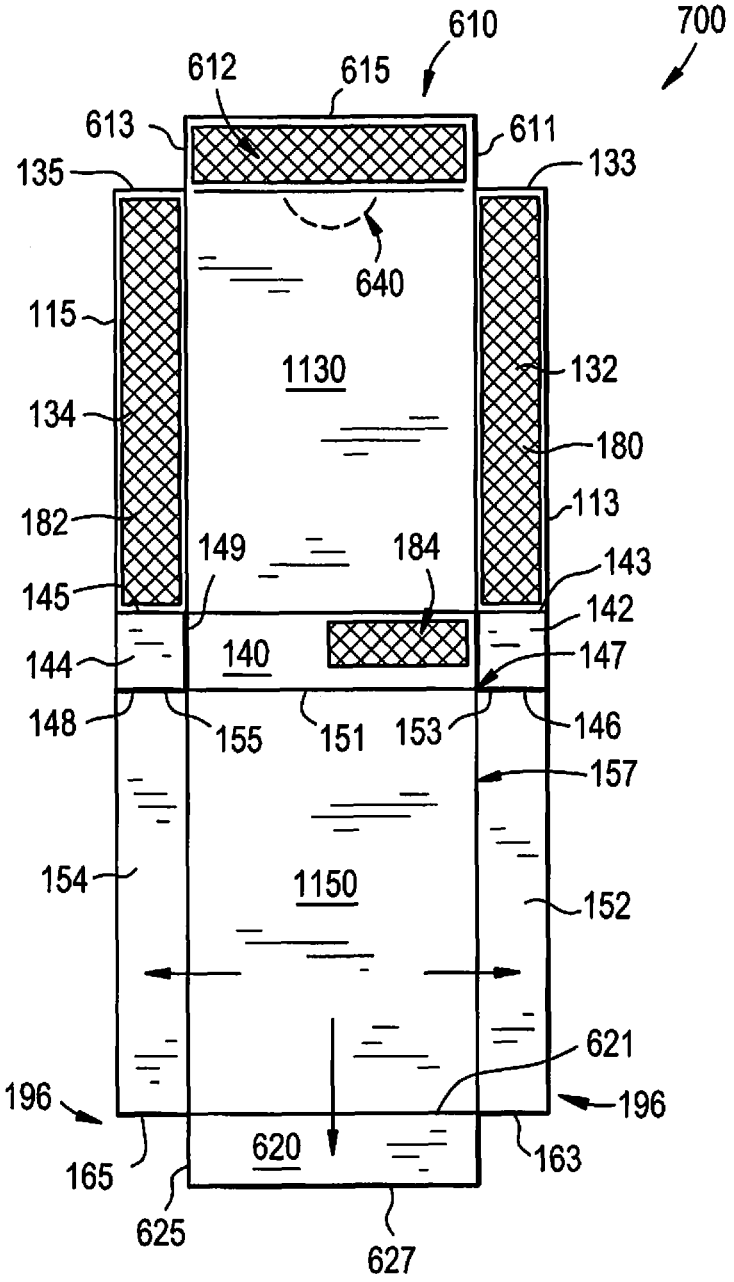

FIG. 8 is a plan view of a printable or clay side of a blank for forming a cartomizer box in accordance with some example embodiments.

Figure 9:
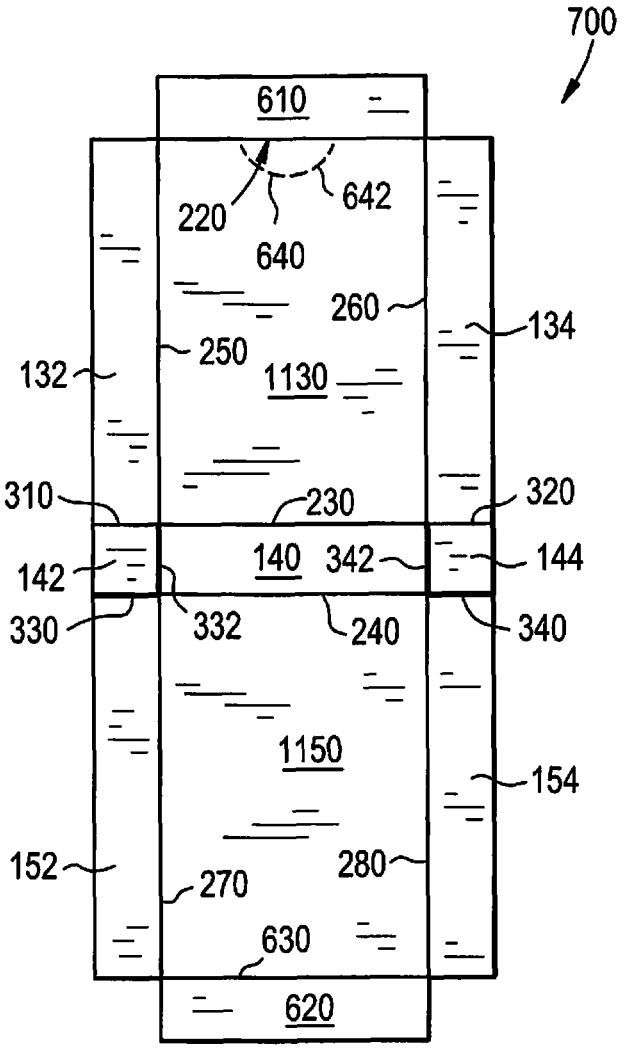

Referring to FIG. 8, a blank 700 includes a top (or upper) glue panel 610, a back panel 1130, a bottom panel 140, a front panel 1150, and a lower panel 620. In accordance with some example embodiments, the blank 700 as shown in FIG. 8 is similar to the blank 600 as shown in FIGS. 6 and 7 with the exception that the blank as shown in FIGS. 8 and 9 have different dimensions and the fold lines 650, 652 and 654 form a single line.

In accordance with some example embodiments, the top glue panel 610 is connected to the back panel 1130 at a top edge 131 of the back panel 1130. The top glue panel 610 has a varnish-free area 612, which can cover essentially the entire face of the glue panel 610. The back panel 1130 can include one or more cut lines 640, which form a semi-circular tab 642. The one or more cut lines 640, which form the semi-circular tab 642 can assist with opening of the box 400.

The bottom panel 140 is connected to the front panel 1150 at a bottom edge of the bottom panel 141. The front panel 1150 is connected to the bottom panel 140 at a top edge 151 of the front panel 1150. In accordance with some example embodiments, a first glue panel 132 and a second glue panel 134 can be connected to the back panel 1130 along a first side edge 137 and a second side edge 139 of the back panel 1130. In accordance with some example embodiments, the each of the first and second glue panels 132, 134, have a varnish-free area 180, 182, which can cover essentially the entire face of the glue panels 132, 134.

In accordance with some example embodiments, the bottom panel 140 has a first bottom side panel 142 and a second bottom side panel 144, which extend from a first side edge 147 and second side edge 149 of the bottom panel 140. The first and second glue panels 132, 134 can be connected to the first side bottom panel 142 and the second side bottom panel 144 along a top edge 143, 145, respectively, of the first and second side bottom panels 142, 144. The first and second side bottom panels 142, 144 each have a lower edge 146, 148. In accordance with some example embodiments, the lower edge 146, 148 are free edges, which have been separated from the upper edge 153, 155 of the first and second side panels 152, 154, respectively.

In accordance with some example embodiments, the bottom panel 140 can also include a varnish-free area 184, which can be configured to receive a date code 186. The varnish-free area 184 on the bottom panel 140 can have a rectangular shape and can be located in a lower right or left corner of the bottom panel 140. For example, in accordance with some example embodiments, the varnish-free area 184 can have a width of about 20 mm to about 30 mm, and more preferably about 26 mm, and a height of about 5 mm to about 12 mm, and more preferably about 8 mm.

In accordance with some other example embodiments, the bottom panel 140 may not include the varnish-free area 184 and/or the date code 186. In accordance with some example embodiments, the varnish-free area 184 and/or the date code 186 may be located on another area of the bottom panel 140.

A first side panel 152 and a second side panel 154 extend from a first side edge 157 and a second side edge 159 of the front panel 1150, respectively. The first and second side panels 152, 154 have a top edge 153, 155 and a bottom edge 163, 165, respectively.

In accordance with some example embodiments, each of the first and second side panels 152, 154 have a free edge 163, 165 on a lower edge of the blank 100. The blank 700 has a pair of free edges 113, 115, which extend from an outer portion of the top edge 133, 135 of the first and second glue panels 132, 134 to the free edges 163, 165 of the lower edge of the first and second side panels 152, 154. In accordance with some example embodiments, the corners 196, which transition from the free edges 113, 115 of the blank 100 to the lower free edges 163, 165 of the first and second side panels 152, 154 can be rounded. For example, in accordance with some example embodiments, the corners 196 can have a radius of about 1 mm.

In accordance with some example embodiments, as shown in FIG. 6, the top glue panel 610 has a pair of side edges 611, 613, and a top edge 615. The lower panel 620 is connected to the front panel 1150 along a bottom edge 621 of the front panel 1150. The lower panel 620 can have a pair of side edges 623, 625, and a bottom edge 627.

As shown in FIG. 8, the back panel 1130 and the front panel 1150 can have substantially the same height and width. For example, in accordance with some example embodiments, the back panel 1130 and the front panel 1150 as shown in FIG. 6 can have a width of about 50 mm to 60 mm, and more preferably 55 mm, and a height of about 70 mm to about 90 mm, and more preferably about 79.5 mm to about 80 mm.

In accordance with some example embodiments, the first glue panel 132, the second glue panel 134, the first side panel 152, and the second side panel 154 can have substantially the same height and width. For example, in accordance with some example embodiments, the first glue panel 132, the first side panel 152, and the second side panel 154 can have a width of about 12 mm to 16 mm, and more preferably about 13 mm to 13.4 mm, and a height of about 70 mm to about 90 mm, and more preferably about 79.5 mm to about 80 mm.

In accordance in with some example embodiments, the top glue panel 610, the bottom panel 140, and the lower panel 620 can have substantially the same height and width. For example, in accordance with some example embodiments, the top glue panel 610, the bottom panel 140, and the lower panel 620 can have a width of about 50 mm to 60 mm, and more preferably a width of about 54.2 mm, and a height of about 10 mm to 15 mm, and more preferably the top glue panel 610 and the lower panel 620 have a height of about 13.5 mm, and the bottom panel 140 has a height of about 14 mm.

In accordance with some example embodiments, the blank 100 can have an overall height of about 190 mm to about 210 mm, and more preferably about 200.5 mm, and a width of about 75 mm to about 85 mm, and more preferably about 81 mm.

FIG. 9 is an inside of the blank for forming a cartomizer box as shown in FIG. 8 showing the fold and cut lines.

Referring to FIG. 9, the top glue panel 610 is connected to the back panel 1130 along a first fold line 220. The back panel 1130 is connected to the bottom panel 140 along a second fold line 230. The bottom panel 140 is connected to the front panel 1150 along a third fold line 240. The front panel 1150 is connected to a lower panel 620 along a twelfth fold line 630. The first and second glue panels 132, 134 are connected to the back panel 1130 along a fourth and fifth fold line 250, 260, respectively. The first and second side panels 152, 154 are connected to the front panel 1150 along a sixth and seventh fold line 270, 280, respectively.

In accordance with some example embodiments, the first bottom side panel 142 and the second bottom side panel 144 are connected to the first and second glue panels 132, 134 along a tenth and an eleventh fold line 310, 320. The blank 100 also includes a series of cuts 330, 332, 340, 342, which separates the first and second bottom side panels 142, 144 from the bottom panel 140 to assist with the assembly or gluing of the box structure during assembly.

In accordance with some example embodiments, the box or package 400 can be erected using a blank 100, 500, 600, 700 by folding the first and the second glue panels 152, 154 (or 132, 134 in FIGS. 6-9) along the fold lines 250, 260 (or 270, 280 in FIGS. 6-9). The first and second bottom side panels 142, 144 can then be folded along the fold lines 310, 320. The front 1150 is then folded along the third fold line 240 upward. In accordance with some example embodiments, the first and second side panels 132, 134 (or 152, 154 in FIGS. 6-9) are then bonded (or glued) to the first and second glue panels 152, 154 (or 132, 134 in FIGS. 6-9). The method can also include bonding (or gluing) the lower panel 620 to the top glue panel 610.

In accordance with some example embodiments, the method can include placing a date code area 186 on an inner portion of the bottom panel 140. In accordance with some example embodiments, the method includes placing a blister tray 420 on the blank 100, 500, 600, 700 before and after erecting the blank 100, 500, 600, 700 into a box and package 400. In addition, an optional instructions booklet 410 can be placed inside the assembled box or package 400.

In accordance with some example embodiments, the blanks 100, 500, 600, 700 can be formed of a material selected from the group consisting of cardboard, paperboard, plastic, metal, or combinations thereof. For example, in a preferred example embodiment, the blanks 100, 500, 600, 700 can be formed of cardboard having a weight ranging from about 100 grams per square meter to about 350 grams per square meter.

In accordance with some example embodiments, the blanks 100, 500, 600, 700 can include one or more of printing, embossing, debossing, embellishments and combinations thereof on an outer surface of the blank.

In some example embodiments, the blanks 100, 500, 600, 700 may be formed from any suitable materials including, but not limited to, cardboard, paperboard, plastic, metal, or combinations thereof. The blanks 100, 500, 600, 700 are formed from one or more folded laminar cardboard blanks. Also, the cardboard has a weight ranging from about 100 grams per square meter (gsm) to about 350 grams per square meter.

In some example embodiments, exterior surfaces of the sleeve may be printed, embossed, debossed or otherwise embellished with manufacturer or brand logos, trademarks, slogans and other consumer information and indicia.

As used herein, the terms "front", "back", "upper", "lower", "side", "top", "bottom", "left", "right" and other terms used to describe relative positions of the components of the sleeve refer to the sleeve in an upright position.

As used herein, the term "longitudinal" refers to a direction from bottom to top or vice versa of the box. The term "transverse" refers to a direction perpendicular to the longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

The foregoing is illustrative of some example embodiments and is not to be construed as limiting thereof. Although a few example embodiments have been described, those skilled in the art will readily appreciate that many modifications are possible in example embodiments without materially departing from the novel teachings. Accordingly, all such modifications are intended to be included within the scope of the disclosure as defined in the claims. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed is:

1. A blank capable of being assembled into a display package, the blank comprising:

a top panel connected to a back panel along a first fold line, the first fold line extending along a top edge of the back panel;

a bottom panel connected to the back panel along a second fold line, the second fold line extending along a top edge of the bottom panel;

a front panel connected to the bottom panel along a third fold line, the third fold line extending along a top edge of the front panel;

a first glue panel connected to the back panel along a fourth fold line, the fourth fold line extending along a first side edge of the back panel;

a second glue panel connected to the back panel front along a fifth fold line, the fifth fold line extending along a second side edge of the back panel;

a first side panel connected to the front panel along a sixth fold line, the sixth fold line extending along a first side edge of the front panel;

a second side panel connected to the front panel along a seventh fold line, the seventh fold line extending along a second side edge of the front panel;

a first bottom side panel connected to the first glue panel along an eighth fold line, the eighth fold line extending along a lower edge of the first glue panel;

a second bottom side panel connected to the second glue panel along an ninth fold line, the ninth fold line extending along a lower edge of the second glue panel; and a first and a second cut line extending across a bottom edge of the first and second bottom side panels, respectively, so as to separate the first and second bottom side panels from the bottom panel and the first and second side panels;

a lower panel connected to the front panel along a bottom edge of the front panel;

the top panel being a third glue panel that is configured to be bonded to the lower panel to seal a first end of the display package upon assembly of the display package; and at least one third cut line in a semi-circular shape at an upper portion of back panel, the at least one third cut line being configured to form a tear line on an outermost surface of the assembled display package, the tear line being configured to be torn to open the first end of the display package.

2. The blank of claim 1, wherein the blank is formed of a material selected from cardboard, paperboard, plastic, metal, and combinations thereof.

3. The blank of claim 1, wherein the blank defines fourth and fifth cut lines extending across side edges of the first and second bottom side panels.

4. The blank of claim 1, wherein the tear line is directly accessible on the back panel of the assembled display package.

5. The blank of claim 1, wherein the first fold line includes, an inner fold line along a top of the semi-circular shape of the at least one third cut line, and a first outer fold line and a second outer fold line on sides of the inner fold line, the inner fold line being about collinear with the first and second outer fold lines.

6. The blank of claim 5, wherein, the first outer fold line includes a first raised fold portion defined by the third glue panel, the first raised fold portion being on an end of the first outer fold line that is closest to the inner fold line, and the second outer fold line includes a second raised fold portion defined by the third glue panel, the second raised fold portion being on an end of the second outer fold line that is closest to the inner fold line.

7. The blank of claim 6, wherein, the first raised fold portion includes a first upward sloping fold portion and a first horizontal end fold portion, and the second raised fold portion includes a second upward sloping fold portion and a second horizontal end fold portion, the first and second horizontal end fold portions being about parallel with the first and second outer fold lines.

8. The blank of claim 7, wherein the at least one third cut line includes, a first outwardly turning end slit on a first end of the at least one third cut line, and a second outwardly turning end slit on a second end of the at least one third cut line.

9. The blank of claim 8, wherein, the first outwardly turning end slit has a first distal-most end that points toward a first intersection between the first outer fold line and the first raised fold portion, and the second outwardly turning end slit has a second distal-most end that points toward a second intersection between the second outer fold line and the second raised fold portion.

10. A method of forming a display package, the method comprising:

erecting the display package from a blank, the blank including, a top panel connected to a back panel along a first fold line, the first fold line extending along a top edge of the back panel, a bottom panel connected to the back panel along a second fold line, the second fold line extending along a top edge of the bottom panel, a front panel connected to the bottom panel along a third fold line, the third fold line extending along a top edge of the front panel, a first glue panel connected to the back panel along a fourth fold line, the fourth fold line extending along a first side edge of the back panel, a second glue panel connected to the back panel front along a fifth fold line, the fifth fold line extending along a second side edge of the back panel, a first side panel connected to the front panel along a sixth fold line, the sixth fold line extending along a first side edge of the front panel, a second side panel connected to the front panel along a seventh fold line, the seventh fold line extending along a second side edge of the front panel, a first bottom side panel connected to the first glue panel along an eighth fold line, the eighth fold line extending along a lower edge of the first glue panel, a second bottom side panel connect to the second glue panel along a ninth fold line, the ninth fold line extending along a lower edge of the second glue panel, a first and a second cut line extending across a bottom edge of the first and second bottom side panels, respectively, so as to separate the first and second bottom side panels from the bottom panel and the first and second side panels, the top panel being a third glue panel, a lower panel connected to the front panel along a bottom edge of the front panel, and at least one third cut line in a semi-circular shape at an upper portion of back panel, the at least one third cut line being configured to form a tear line on an outermost surface of the assembled display package, the tear line being configured to be torn to open the first end of the display package, the erecting the display package including, folding the first glue panel and the second glue panel along the fourth and fifth fold lines, folding the first and second bottom side panels along the eighth and ninth fold lines, folding the front panel along the third fold line, bonding the first and second side panels to the first and second glue panels, and bonding the third glue panel to the lower panel to seal a first end of the display package.

11. The method of claim 10, wherein the erected display package is configured to be opened by, tearing the tear line to open the first end of the display package.

12. The method of claim 11, further comprising:

placing at least one blister pack on the blank before the bonding the first and second side panels.

13. The method of claim 12, wherein the at least one blister pack comprises two-or-four cavities, and each of the cavities is configured to hold at least one cartomizer.

14. The method of claim 10, further comprising:

forming the blank into a flat die-cut manner, prior to the erecting the display package.

15. The method of claim 10, further comprising:

placing at least one blister pack on the blank simultaneously with the folding the front panel.

16. The method of claim 10, further comprising:

placing at least one blister pack on the blank simultaneously with the folding the first and second bottom side panels.

17. The method of claim 10, wherein the erecting of the display package further includes the blank defining fourth and fifth cut lines extending across side edges of the first and second bottom side panels.

18. The method of claim 10, wherein the tear line is directly accessible on the back panel of the assembled display package.

19. The method of claim 10, wherein the first fold line includes, an inner fold line along a top of the semi-circular shape of the at least one third cut line, and a first outer fold line and a second outer fold line on sides of the inner fold line, the inner fold line being about collinear with the first and second outer fold lines.

20. The method of claim 19, wherein, the first outer fold line includes a first raised fold portion defined by the third glue panel, the first raised fold portion being on an end of the first outer fold line that is closest to the inner fold line, and the second outer fold line includes a second raised fold portion defined by the third glue panel, the second raised fold portion being on an end of the second outer fold line that is closest to the inner fold line.

21. The method of claim 20, wherein, the first raised fold portion includes a first upward sloping fold portion and a first horizontal end fold portion, and the second raised fold portion includes a second upward sloping fold portion and a second horizontal end fold portion, the first and second horizontal end fold portions being about parallel with the first and second outer fold lines.

22. The method of claim 21, wherein the at least one third cut line includes, a first outwardly turning end slit on a first end of the at least one third cut line, and a second outwardly turning end slit on a second end of the at least one third cut line.

23. The method of claim 22, wherein, the first outwardly turning end slit has a first distal-most end that points toward a first intersection between the first outer fold line and the first raised fold portion, and the second outwardly turning end slit has a second distal-most end that points toward a second intersection between the second outer fold line and the second raised fold portion.

* * * * *